US008980817B2

(12) United States Patent
Wiedemann et al.

(10) Patent No.: US 8,980,817 B2
(45) Date of Patent: Mar. 17, 2015

(54) DOSAGE ELEMENT AND A METHOD OF MANUFACTURING A DOSAGE ELEMENT

(75) Inventors: Ralf Wiedemann, Mira (IT); Pavlinka Roy, Ludwigshafen (DE); Frederic Moreux, Barcelona (ES)

(73) Assignee: Reckitt Benckiser N.V., Hoofddorp (NL)

( * ) Notice: Subject to any disclaimer, the term of this patent is extended or adjusted under 35 U.S.C. 154(b) by 261 days.

(21) Appl. No.: 12/523,557

(22) PCT Filed: Jan. 17, 2008

(86) PCT No.: PCT/GB2008/000166
§ 371 (c)(1),
(2), (4) Date: Jan. 13, 2010

(87) PCT Pub. No.: WO2008/087424
PCT Pub. Date: Jul. 24, 2008

(65) Prior Publication Data

US 2010/0113318 A1 May 6, 2010

(30) Foreign Application Priority Data

Jan. 18, 2007 (GB) ..... 0700921.0
May 30, 2007 (GB) ..... 0710226.2

(51) Int. Cl.
*C11D 17/00* (2006.01)
*C11D 17/04* (2006.01)
*C11D 11/00* (2006.01)

(52) U.S. Cl.
CPC ..... *C11D 17/043* (2013.01); *C11D 17/0047* (2013.01); *C11D 11/00* (2013.01); *C11D 17/044* (2013.01)
USPC ..... 510/445; 510/220; 510/221; 510/224; 510/403; 510/438; 510/439

(58) Field of Classification Search
CPC .... C11D 17/043; C11D 17/044; C11D 17/00; C11D 17/0047; C11D 11/00
USPC ..... 510/220, 221, 224, 403, 438, 439, 445
See application file for complete search history.

(56) References Cited

U.S. PATENT DOCUMENTS 4,961,754 A * 10/1990 Grollier ..... 8/423
5,362,413 A 11/1994 Kaufmann (Continued)

FOREIGN PATENT DOCUMENTS

DE 10233564 A1 10/2003
DE 102006031337 A1 1/2007

(Continued)

OTHER PUBLICATIONS

English Language Abstract for DE10233564 taken from esp@cenet.com.

(Continued)

*Primary Examiner* — Lorna M Douyon
(74) *Attorney, Agent, or Firm* — Troutman Sanders LLP; Ryan A. Schneider; Elizabeth-Ann Weeks

(57) ABSTRACT

A dosage element to be consumed in use in a ware washing machine, the dosage element comprises a container, whereby the container encloses a non-consolidated particulate composition and a gel in direct contact with one another.

17 Claims, 1 Drawing Sheet

(56) References Cited

U.S. PATENT DOCUMENTS

Figures 1A, 1B, 1C, 1D, 1E, 1F, 1G, 1H, 2:
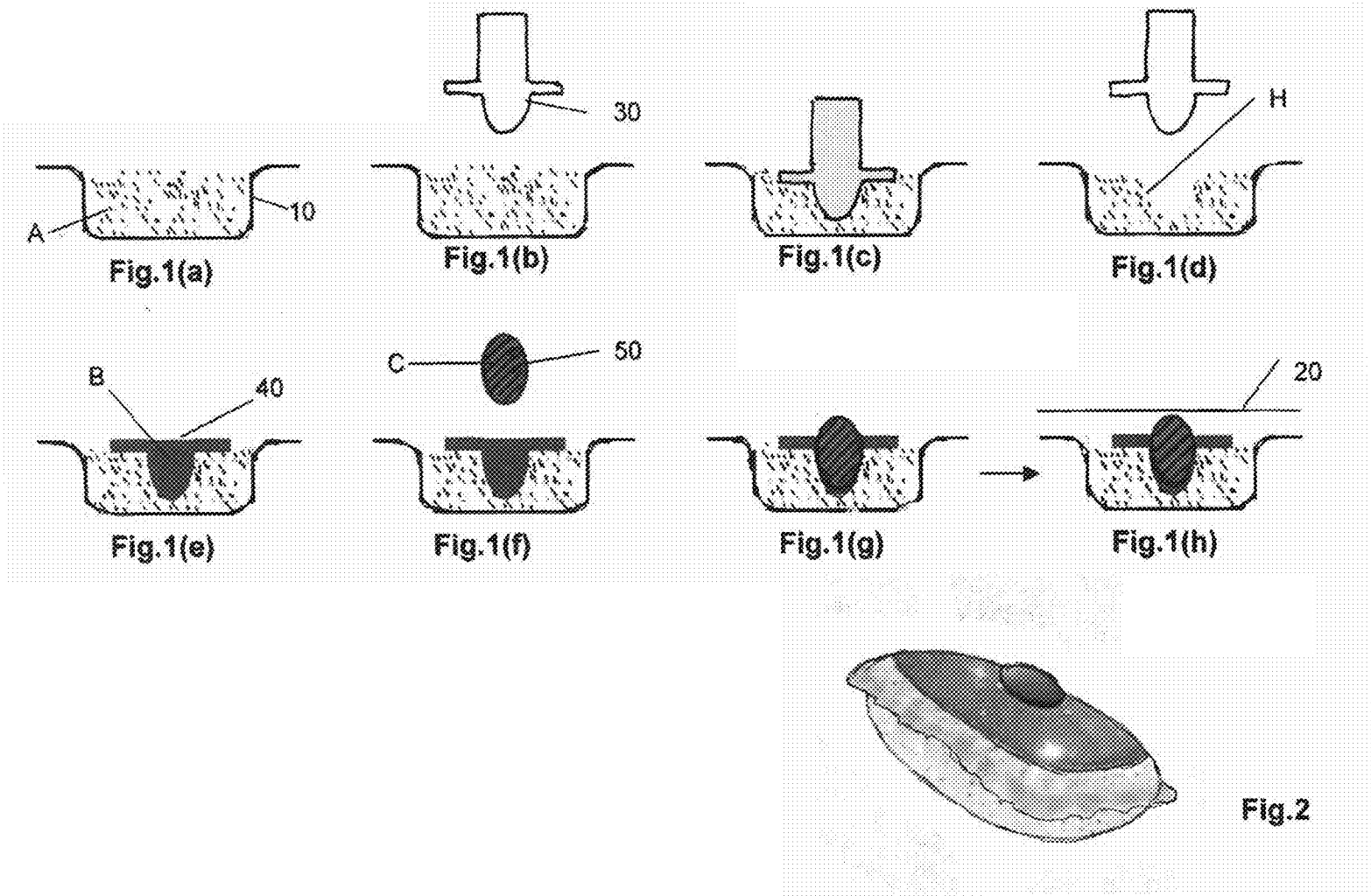

| | | | | |
|---|---|---|---|---|
| 6,486,117 | B1 | 11/2002 | Painter et al. | |
| 6,492,312 | B1 * | 12/2002 | Pfeiffer et al. | 510/221 |
| 7,179,781 | B2 * | 2/2007 | Fine et al. | 510/438 |
| 7,407,923 | B2 * | 8/2008 | Wiedemann et al. | 510/296 |
| 2003/0114333 | A1 * | 6/2003 | Somerville-Roberts et al. | 510/297 |
| 2003/0139318 | A1 * | 7/2003 | Pfeiffer et al. | 510/439 |
| 2004/0029764 | A1 * | 2/2004 | Weber et al. | 510/446 |
| 2004/0118711 | A1 | 6/2004 | Duffield | |
| 2004/0121926 | A1 * | 6/2004 | Waits et al. | 510/221 |
| 2005/0049164 | A1 * | 3/2005 | Sommerville-Roberts et al. | 510/293 |
| 2005/0225003 | A1 | 10/2005 | Holderbaum et al. | |
| 2005/0245418 | A1 * | 11/2005 | Fregonese et al. | 510/392 |
| 2005/0261155 | A1 * | 11/2005 | Wiedemann et al. | 510/295 |
| 2006/0016715 | A1 | 1/2006 | Fregonese | |
| 2008/0248989 | A1 | 10/2008 | Holderbaum | |

FOREIGN PATENT DOCUMENTS

| | | | |
|---|---|---|---|
| EP | 1506925 | A1 | 2/2005 |
| EP | 1679362 | A1 | 7/2006 |
| GB | 2367828 | A | 4/2002 |
| GB | 2374580 | A | 10/2002 |
| GB | 2374581 | A | 10/2002 |
| GB | 2374582 | A | 10/2002 |
| GB | 2390840 | A | 1/2004 |
| GB | 2414958 | A * | 12/2005 |
| WO | 0185898 | A1 | 11/2001 |
| WO | 0208380 | A1 | 1/2002 |
| WO | 0242408 | A2 | 5/2002 |
| WO | 03072694 | A1 | 9/2003 |
| WO | 2004014753 | A1 | 2/2004 |
| WO | 2004103849 | A1 | 12/2004 |
| WO | 2005121302 | A1 | 12/2005 |
| WO | 2005123511 | A1 | 12/2005 |
| WO | 2007116357 | A2 | 10/2007 |

OTHER PUBLICATIONS

English language abstract of DE102006031337 found on esp@cenet.com.

English language abstract of EP1506925 found on esp@cenet.com.

* cited by examiner

10
A

30

H

40
B

50
C

20

DOSAGE ELEMENT AND A METHOD OF MANUFACTURING A DOSAGE ELEMENT

This is an application file under 35 USC 37 1of PCT/GB2008/000166.

The invention relates to a dosage element for a ware washing machine and to a method of manufacture thereof.

Ware washing machines, such as automatic clothes washing and dishwashing machines, typically utilise detergents and other additives in solid, liquid or powder form. These substances are either administered directly into the machine, or dispensed via a tray or a dedicated compartment system to be added to the washing area at the start of, or during, a washing cycle.

Often, the required detergents/additives are administered as a compound tablet comprising a plurality of active ingredients. These may be kept separate for reasons of incompatibility. Alternatively or additionally they may be kept separate so that they may be activated at different points during a washing cycle or rinsing cycle. This activation at a particular point may be achieved by including time and/or temperature dependent released elements within the composition. One technique involves the coating or encasing of individual active components of the compound tablet within a water, soluble polymer or gel of given properties/thickness to provide a time delayed and/or temperature dependent exposure to the component within so that it is exposed to the wash liquor within the ware washing machine at the desired point in a cycle.

In compound dosage elements of the type described above, individual active components may be in any state such as a solid, particulate or liquid form.

With the need to accommodate perhaps three or four active components within a single convenient dosage element, comes the complication of isolating each component from its neighbour and providing the dosage element within an overall compact package. These issues lead to complications within the manufacturing process and an increase in the costs of production. Accordingly, it is one aim of preferred embodiments of the present invention to provide a relatively simple dosage, element formation and uncomplicated method of construction.

Consumers are becoming increasingly reluctant to handle detergent compositions directly as there are perceived health/hygiene issues to doing so. With this in mind, it is desired to provide a barrier between the hand of the consumer and the ingredients of the dosage element and to reduce the risks of inadvertent exposure of the consumer to active ingredients of the tablet.

According to a first aspect of the invention, there is provided a dosage element to be consumed in use in a ware washing machine, the dosage element comprising a container, whereby the container encloses a non-consolidated particulate composition and a gel in direct contact with one another.

In the present invention the dosage element is suitably consumed in a washing cycle, in the sense that at the end of cycle no part of it has to be removed from the machine; indeed, preferably, no part of it can be discerned, within the machine.

The gel may have been applied to the particulate composition as a pre-formed, preferably shape-stable, gel body or may have been applied as a less viscous gel material or as a liquid (both of which we call a gel precursor). When it is a less viscous gel material it preferably becomes more viscous, and preferably sets to become shape stable, in situ, in or on the particulate composition. In this embodiment the gel precursor is preferably a gel itself, suitably a viscous material but flowable, either under gravity or when pumped. Preferably its viscosity when introduced is at least 1,000 mPa·s., preferably at least 5,000 mPa·s., preferably at least 10,000 mPa·s., measured at 25° C. on a Brookfield viscometer, RVDV-II+, spindle no. 27, speed 2.5 rpm.

Preferably the gel, and the gel precursor when provided, does not seep into the particulate composition. Rather, it stands atop or underneath the particulate composition.

The selection of the particulate composition and gel (or gel precursor when provided) may be such that seepage of the gel (or gel precursor when provided) into the particulate composition is substantially prevented. Alternatively or additionally the surface of the composition which is to come into contact with the gel (or gel precursor when provided) may have been treated with a composition (for example by spraying) in order to prevent seepage.

Preferably, said container is pre-charged with said particulate composition which is then locally displaced to provide a space on top of the particulate composition for said gel (or gel precursor when provided) which is introduced prior to capping and sealing the container with a lid. In an alternative embodiment, said container is pre-charged with said gel (or gel precursor when provided) which is then locally displaced to provide a space for said particulate composition which is introduced prior to capping and sealing the container with a lid. In this alternative embodiment the gel/gel precursor is located underneath the particulate composition.

The gel may include a protruding portion which protrudes into the particulate composition and a second wider portion, from which the protruding portion depends. The wider portion locates at the top surface (or bottom surface for the alternative embodiment) of the particulate composition and may serve as a barrier or partial barrier between a cover of the dosage element and the particulate composition, helping to keep the cover of clean appearance.

A further component comprising one or more active washing agents may be present in the container. The further component may lie in or on the gel or gel precursor. Preferably, the further component is a solid form such as a "pill". In particular it may be a compressed pill or an article coated with a water-soluble polymer.

When the particulate composition is displaced it preferably holds its shape, without being solidly compacted, however. If necessary the particulate composition could contain a binder which provides that the particulate composition holds its shape where displaced, but is still mobile or flowable overall, to assist filling with the particulate composition and to give the dosage element a desired appearance and/or tactile quality.

Preferably the container is of water-soluble polymeric material(s).

Water-soluble herein includes water-dispersible.

Preferably the dosage element is not of squared-off, cuboid appearance and/or is preferably not rigid. Preferably is not box-like, in look or feel. Preferably it is of somewhat rounded, preferably pillow-like appearance, and/or is of compliant or "squashy" feel.

Preferably the weight of the dosage element is up to 34 g, preferably up to 30 g.

Preferably the weight of the dosage element is at least 4 g, preferably at least 10 g, preferably at least 14 g.

Preferably the weight of the particulate composition is up to 30 g, preferably up to 26 g.

Preferably the weight of the particulate composition is at least 8 g, preferably at least 12 g, preferably at least 14 g.

Preferably the weight of the gel is up to 12 g, preferably up to 8 g, preferably up to 5 g.

Preferably the weight of the gel is at least 1 g, preferably at least 2 g, preferably at least 2.4 g.

Preferably the weight of a further component e.g. a "pill", when present, is up to 6 g, preferably up to 3 g.

Preferably the weight of a further component e.g. a "pill", when present, is at least 0.5 g, preferably at least 1.8 g, preferably at least 1 g.

Preferably the weight of the water-soluble polymeric material(s), in total, is at least 0.1 g, preferably at least 0.2 g, preferably at least 0.3 g.

Preferably the weight of the water-soluble polymeric material(s), in total, is up to 2 g, preferably up to 1 g, preferably up to 0.7 g.

Preferably the ratio by weight of the particulate composition to the gel is in the range 1:1 to 20:1, preferably 2:1 to 12:1, preferably 4:1 to 9:1.

Preferably the ratio by weight of the said substances contained in the dosage element (particulate composition, gel and further component e.g. a "pill", when present), to the total water-soluble polymeric material(s) (the sum thereof making up the total weight of the dosage element) is in the range 10:1 to 100:1, preferably 16:1 to 60:1, preferably 24:1 to 40:1.

Preferably, the container is made by forming a water-soluble sheet or film into a receptacle, delivering the particulate composition into the receptacle (without consolidating it), delivering the gel into the receptacle, and applying a water-soluble lid, preferably also a sheet or film, to the charged receptacle. In the alternative embodiment, where the gel/gel precursor is underneath the particulate composition, the gel/gel precursor is delivered into the receptacle (without consolidating it), the particulate composition is delivered into the receptacle and a water-soluble lid is applied, preferably also a sheet or film, to the charged receptacle. The receptacle is preferably formed by thermoforming, but could be formed by injection moulding. The same applies to the lid.

Preferred water-soluble sheet or film materials are flexible, in the sense that when subjected to a deflecting force they do not generate a force acting to restore them to their previous position or shape (as would a "flexible" plastics ruler).

Preferably the receptacle and the lid have peripheral regions, which are arranged face-to-face when the parts are brought together for closing of the receptacle. These regions are suitably the means by which the receptacle and lid are joined. They are sealed to each other in face-to-face relation, in the finished dosage element. Thus, the dosage element suitably has a peripheral skirt, which represents the sealing zone.

The receptacle and the lid may be sealed together by means of an adhesive, preferably an aqueous liquid, preferably a PVOH solution or water. The adhesive may be applied to one of both peripheral regions. Alternatively they may be sealed together by heat sealing. Other methods of sealing include infra-red, radio frequency, ultrasonic, laser, solvent (such as water), vibration and spin welding. If heat sealing is used, a suitable sealing temperature is for example 125° C. A suitable sealing pressure is readily selected by the person skilled in the art.

Preferably, the walls of, or within, the container are of film or sheet material having a thickness of between 30 and 600 μm. When thermoforming is used, the thickness is preferably in the range 30-250 μm, preferably 40-200 μm, preferably 50-150 μm. When injection moulding is used, the thickness is preferably in the range 200-600 μm, preferably 240-600 μm preferably 250-400 μm.

Suitable water-soluble polymeric materials for use in this invention are such that discs of 100 μm thickness and 30 mm diameter dissolve in 5 liters of water maintained at 50° C., under gentle stirring, in less than 30 minutes.

A water-soluble polymeric material for use herein may suitably be selected from the group comprising polyvinyl alcohols, polyvinyl alcohol copolymers, partially hydrolyzed polyvinyl acetates, cellulose derivatives (such as alkylcelluloses, hydroxyalkylcelluloses, salts, ethers and esters of alkylcelluloses and hydroxyalkylcelluloses, for example, hydroxypropylcellulose, hydroxypropylmethyl- cellulose and sodium carboxymethylcellulose); polyglycolides, polyglycolic acids, polylactides, polylactic acids; polyvinyl pyrrolidines, polyacrylic acids or salts or esters thereof, polymaleic acids or salts or esters thereof, dextrins, maltodextrins, polyacrylamides, acrylic acid/maleic anhydride copolymers, including copolymers (which includes terpolymers), and blends. Optionally fillers, plasticisers and process aids may also be comprised in the formulation of a water-soluble polymeric material for use herein.

Preferred polymeric materials for are selected from the group comprising polyvinyl alcohols, polyvinyl alcohol copolymers, and partially hydrolyzed polyvinyl acetates. An especially preferred water-soluble polymeric material comprises a poly(vinyl alcohol).

Preferably, in the first embodiment prior to the capping and sealing operation a pill or core of material is introduced to sit in or on said gel/gel precursor which is on top of the particulate composition. In the alternative embodiment, where the gel/gel precursor is underneath the particulate composition, a pill or core of material is either introduced a) before or as the gel/gel precursor is delivered into the receptacle and is thus located at the bottom of the gel/gel precursor adjacent to the receptacle bottom film or in the gel/gel precursor or b) after the gel/gel precursor is delivered into the receptacle but prior to the introduction of the particulate material and is thus located at the interface between gel/gel precursor and particulate material. The gel may form a barrier between the particulate composition and the pill or core. This arrangement may minimize the risk of potentially adverse interactions between the particulate composition (which will typically have a residual moisture content) and the pill or core (which may contain a component such as a bleach or enzyme which may potentially be significantly degraded by contact with a component containing even low levels of moisture.

However it is not excluded, in the alternative, that a pill or core could be located in the space formed in the particulate composition, and the gel or gel precursor is then introduced into the remaining space as described hereinabove.

In summary the gel preferably comprises an organic solvent and/or a non-ionic surfactant, a gelling aid when needed and optionally dye, fragrance and other wash actives dispersed therein. It can be derived from a melt which solidifies or a gel precursor which gellifies. Anhydrous gels are preferred. Anhydrous shall mean that the gel preferably has less than 20%, water, preferably less than 10%, preferably less than 5%, and most preferably less than 2% water. When water is used it shall be bound water which will not (or only to a limited extent) migrate into the particulate portion.

The gel may comprise a thickening system and other optional detergent components. In addition the anhydrous gel may also comprise solid ingredients to aid in the control of the viscosity of the gel in conjunction with the thickening system. Solid ingredients may also act to optionally disrupt the gel thereby aiding dissolution of the gel. The gel portion may suitably comprise 20% solid ingredients, more preferably at least 40% solid ingredients and most preferably at least 80% solid ingredients. However, due to the need to be able to pump and otherwise process the gel, the gel typically does not include more than 70% solid ingredients.

The particle size of the solids should be no more than 20% being bigger than 1.2 mm, more preferably no more than 20% being bigger than 0.8 mm and most preferably no more than 20% being bigger than 0.4 mm. A preferred particle size is 0.2 mm and smaller.

The gel comprises a thickening system to provide the required viscosity or thickness of the gel. The thickening system may typically comprise a) a liquid diluent and b) an organic or polymeric gelling additive.

a) Liquid Diluent: the term "diluent" is used herein to connote the liquid portion of the thickening system. While some of the components of the non-compressed portion may dissolve in the diluent-containing phase, other components may be present as particulate material dispersed in it. Preferred diluents are non-aqueous.

Suitable diluents useful in the non-aqueous thickening systems herein include alkylene glycol mono lower alkyl ethers, propylene glycols, ethoxylated or propoxylated ethylene or propylene, glycerol esters, glycerol triacetate, lower molecular weight polyethylene glycols, lower molecular weight methyl esters, amides and preferably non-ionic surfactants. A preferred type of diluent for use herein comprises the mono-, di-, tri-, or tetra-C2-C3 alkylene glycol mono C2-C6 alkyl ethers. The specific examples of such compounds include diethylene glycol monobutyl ether, tetraethylene glycol monobutyl ether, dipropylene glycol monoethyl ether, and dipropylene glycol monobutyl ether. Diethylene glycol mono butyl ether and dipropylene glycol monobutyl ether are especially preferred. Compounds of the type have been commercially marketed under the tradenames Dowanol, Carbitol, and Cellosolve.

Another preferred type of diluent useful herein comprises the lower molecular weight polyethylene glycols (PEGs). Such materials are those having molecular weights of at least 150. PEGs of molecular weight ranging from 200 to 600 are most preferred.

Another preferred type of diluent comprises lower molecular weight methyl esters. Such materials are those of the general formula: R—C(O)—OCH3 wherein R ranges from 1 to 18. Examples of suitable lower molecular weight methyl esters include methyl acetate, methyl propionate, methyl octanoate, and methyl dodecanoate.

Another preferred type of diluent comprises nonionic-surfactants and definitions of such compounds are given hereinafter and are applicable to the gel phase now being described.

The diluent(s) employed should, of course, be compatible and non-reactive with the other optional detergent components, e.g. enzymes. Such a diluent will generally be utilized in an amount of from 10% to 60% by weight of the gel portion. More preferably, a diluent will comprise from 20% to 50% by weight of the gel portion, most preferably from 30% to 50% by weight of the gel portion.

b) Gelling Additive: a gelling agent or additive is added to the diluent mentioned above to complete the thickening system. To form the gel required for suitable phase stability and acceptable rheology of the gel, the organic gelling agent is generally present to the extent of 0.1-8.0% in the gel formulation, preferably 0.2-2.0% of the formulation. Gelling agents of the present invention are selected from organic or polymeric gelling additives which melt/dissolve in the diluent matrix at elevated temperatures. The preferred gelling agents of the present invention are selected from high molecular weight polyethylene glycols, organic acid derivatives such as alcoxylated fatty acids, gelatine or sugar/gelatine combinations, glycerol derivatives, organic acid amide derivatives such as N-lauryl-L-glutamic acid di-n-butyl amide, polyvinyl pyrrolidones and mixtures thereof. Polyethylene glycols when employed as gelling agents, rather than diluents, are high molecular weight materials, having a molecular weight range of from 1000 to 35000, with 6000 to 20000 being the most preferred.

For the purposes of the present invention type A or B gelatin may be used as gelling agent. Type A gelatin is preferred since it has greater stability in alkaline conditions in comparison to type B. Preferred gelatin also has a bloom strength of between 65 and 300, most preferably between 75 and 100. In combinations with sugar the sugar may be any monosaccharide (e.g. glucose), disaccharide (e.g. sucrose or maltose) or polysaccharide. The most preferred sugar is commonly available sucrose.

The gel may include other structure modifying agents. Structure modifying agents include various polymers and mixtures of polymers included polycarboxylates, preferably polyacrylic acid polymers and copolymers, cellulose polymers and derivatives thereof, preferably carboxymethylcelluloses and starches. Other structure modifying ingredients are clays and organo modified clays and silica. The structure modifying ingredients may also aid in adsorption of excess solvent and/or reduce or prevent "bleeding" or leaking of the solvent from the gel portion, reduce shrinkage or cracking of the gel portion or aid in the dissolution or breakup of the gel portion in the wash. Cellulose and cellulose derivatives when employed in the present invention preferably include: i) cellulose acetate and cellulose acetate phthalate (CAP); ii) hydroxypropyl methyl cellulose (HPMC); iii) carboxy methylcellulose (CMC); and mixtures thereof.

The gel may include a variety of other ingredients in addition to the thickening agent as herein before described. Ingredients such as dyes and fragrances may be included.

Other ingredients of the gel may include builders, co-builders, alkalis, bleach, bleach activator, enzymes, fragrance, dye, corrosion inhibitors and further auxiliaries.

The density of the anhydrous gel portion is generally from 0.7 g/cm$^3$ to 2.0 g/cm$^3$, more preferably from 0.9 g/cm$^3$ to 1.8 g/cm$^3$, most preferably from 1.1 g/cm$^3$ to 1.6 g/cm$^3$.

A preferred dosage form of the invention is a laundry washing tablet or, most preferably, a dishwashing tablet. We use the term tablet here to denote a body which can be handled by a consumer as a discrete element, for example as a unit dose. Preferably the first and second substances comprise laundry detergent compositions, or, especially, dishwashing detergent compositions.

Preferred components of a dishwashing tablet, in particular of the particulate portion of the dishwashing tablet of the invention, are as follows:

Bleaching Compounds

Any type of bleaching compound conventionally used in detergent compositions may be used according to the present invention. Preferably the bleaching compound is selected from inorganic peroxides or organic peracids, derivatives thereof (including their salts) and mixtures thereof. Especially preferred inorganic peroxides are percarbonates, perborates and persulphates with their sodium and potassium salts being most preferred. Sodium percarbonate and sodium perborate are most preferred, especially sodium percarbonate.

Organic peracids include all organic peracids traditionally used as bleaches, including, for example, perbenzoic acid and peroxycarboxylic acids such as mono-or diperoxyphthalic acid, 2-octyldiperoxysuccinic acid, diperoxydodecanedicarboxylic acid, diperoxy-azelaic acid and imidoperoxycarboxylic acid and, optionally, the salts thereof. Especially preferred is phthalimidoperhexanoic acid (PAP).

Desirably the bleaching compound is present in the compositions in an amount of from 1 to 60 wt %, especially 5 to 55 wt %, most preferably 10 to 50% wt, such as 10 to 20% wt. When the compositions of the invention comprise two or more distinct regions, the amount of bleaching compound typically present in each can be chosen as desired although the total amount of the bleaching compound will typically be within the amounts stated hereinabove.

Builders

The detergent compositions may also comprise conventional amounts of detergent builders which may be either phosphorous based or non-phosphorous based, or even a combination of both types. Suitable builders are well known in the art.

If phosphorous builders are to be used then it is preferred that mono-phosphates, di-phosphates, tri-polyphosphates or oligomeric-polyphosphates are used. The alkali metal salts of these compounds are preferred, in particular the sodium salts. An especially preferred builder is sodium tripolyphosphate (STPP).

The non-phosphorous based builder may be organic molecules with carboxylic group(s), amino acid based compound or a succinate based compound. The term 'succinate based compound' and 'succinic acid based compound' are used interchangeably herein.

Builder compounds which are organic molecules containing carboxylic groups include citric acid, fumaric acid, tartaric acid, maleic acid, lactic acid and salts thereof. In particular the alkali or alkaline earth metal salts of these organic compounds may be used, and especially the sodium salts. An especially preferred builder is sodium citrate.

Preferred examples of amino acid based compounds according to the invention are MGDA (methyl-glycine-diacetic acid, and salts and derivatives thereof) and GLDA (glutamic-N,N-diacetic acid and salts and derivatives thereof). GLDA (salts and derivatives thereof) is especially preferred according to the invention, with the tetrasodium salt thereof being especially preferred. Other suitable builders are described in U.S. Pat. No. 6,426,229 which is incorporated by reference herein. Particular suitable builders include; for example, aspartic acid-N-monoacetic acid (ASMA), aspartic acid-N,N-diacetic acid (ASDA), aspartic acid-N-monopropionic acid (ASMP), iminodisuccinic acid (IDA), N-(2-sulfomethyl)aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), α-alanine-N,N-diacetic acid (α-ALDA), β-alanine-N,N-diacetic acid (β-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N, N-diacetic acid (TUDA) and sulfomethyl-N,N-diacetic acid (SMDA) and alkali metal salts or ammonium salts thereof.

Further preferred succinate compounds are described in U.S. Pat. No. 5,977,053 and have the formula;

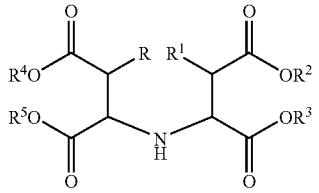

in which R, $R^1$, independently of one another, denote H or OH, $R^2$, $R^3$, $R^4$, $R^5$, independently of one another, denote a cation, hydrogen, alkali metal ions and ammonium ions, ammonium ions having the general formula $R^6R^7R^8R^9N+$ and $R^6$, $R^7$, $R^8$, $R^9$, independently of one another, denoting hydrogen, alkyl radicals having 1 to 12 C atoms or hydroxyl-substituted alkyl radicals having 2 to 3 C atoms. A preferred example is tetrasodium iminosuccinate.

Preferably the total amount of builder present in the compositions of the invention is an amount of at least 5 wt %, preferably at least 10 wt %, more preferably at least 20 wt %, and most preferably at least 25 wt %, preferably in an amount of up to 70 wt %, preferably up to 65 wt %, more preferably up to 60 wt %, and most preferably up to 35 wt %. The actual amount used will depend upon the nature of the builder used.

The detergent compositions of the invention may further comprise a secondary builder (or cobuilder). Preferred secondary builders include homopolymers and copolymers of polycarboxylic acids and their partially or completely neutralized salts, monomeric polycarboxylic acids and hydroxycarboxylic acids and their salts, phosphates and phosphonates, and mixtures of such substances. Preferred salts of the abovementioned compounds are the ammonium and/or alkali metal salts, i.e. the lithium, sodium, and potassium salts, and particularly preferred salts is the sodium salts.

Secondary builders which are organic are preferred.

Suitable polycarboxylic acids are acyclic, alicyclic, heterocyclic and aromatic carboxylic acids, in which case they contain at least two carboxyl groups which are in each case separated from one another by, preferably, no more than two carbon atoms.

Polycarboxylates which comprise two carboxyl groups include, for example, water-soluble salts of, malonic acid, (ethylenedioxy)diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid.

Another suitable polycarboxylic acid is the homopolymer of acrylic acid. Other suitable builders are disclosed in WO 95/01416, to the contents of which express reference is hereby made.

Surfactants

The detergent compositions of the invention may contain surface active agents, for example, anionic, cationic, amphoteric or zwitterionic surface active agents or mixtures thereof. Many such surfactants are described in Kirk Othmer's Encyclopedia of Chemical Technology, 3rd Ed., Vol. 22, pp. 360-379, "Surfactants and Detersive Systems", incorporated by reference herein. In general, bleach-stable surfactants are preferred.

A preferred class of nonionic surfactants is ethoxylated non-ionic surfactants prepared by the reaction of a monohydroxy alkanol or alkylphenol with 6 to 20 carbon atoms. Preferably the surfactants have at least 12 moles particularly preferred at least 16 moles, and still more preferred at least 20 moles of ethylene oxide per mole of alcohol or alkylphenol.

Particularly preferred non-ionic surfactants are the non-ionics from a linear chain fatty alcohol with 16-20 carbon atoms and at least 12 moles particularly preferred at least 16 and still more preferred at least 20 moles of ethylene oxide per mole of alcohol.

According to one embodiment of the invention, the non-ionic surfactants additionally may comprise propylene oxide units in the molecule. Preferably these PO units constitute up to 25% by weight, preferably up to 20% by weight and still more preferably up to 15% by weight of the overall molecular weight of the non-ionic surfactant.

Surfactants which are ethoxylated mono-hydroxy alkanols or alkylphenols, which additionally comprises polyoxyethylene-polyoxypropylene block copolymer units may be used. The alcohol or alkylphenol portion of such surfactants constitutes more than 30%, preferably more than 50%, more preferably more than 70% by weight of the overall molecular weight of the non-ionic surfactant.

Another class of suitable non-ionic surfactants includes reverse block copolymers of polyoxyethylene and polyoxypropylene and block copolymers of polyoxyethylene and polyoxypropylene initiated with trimethylolpropane.

Another preferred class of nonionic surfactant can be described by the formula:

$$R^1O[CH_2CH(CH_3)O]_x[CH_2CH_2O]_y[CH_2CH(OH)R^2]$$

where $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R^1O[CH_2CH(R^3)O]_x[CH_2]_kCH(OH)[CH_2]_jOR^2$$

where $R^1$ and $R^2$ represent linear or branched chain, saturated or unsaturated, aliphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group, x is a value between 1 and 30 and, k and j are values between 1 and 12, preferably between 1 and 5. When the value of x is >2 each $R^3$ in the formula above can be different. $R^1$ and $R^2$ are preferably linear or branched chain, saturated or unsaturated, aliphatic or aromatic hydrocarbon groups with 6-22 carbon atoms, where group with 8 to 18 carbon atoms are particularly preferred. For the group $R^3H$, methyl or ethyl are particularly preferred. Particularly preferred values for x are comprised between 1 and 20, preferably between 6 and 15.

As described above, in case x>2, each $R^3$ in the formula can be different. For instance, when x=3, the group $R^3$ could be chosen to build ethylene oxide ($R^3$=H) or propylene oxide ($R^3$=methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH(R^3)O]_xCH_2CH(OH)CH_2OR^2$$

The use of mixtures of different nonionic surfactants is suitable in the context of the present invention, for instance, mixtures of alkoxylated alcohols and hydroxy group containing alkoxylated alcohols.

Other suitable surfactants are disclosed in WO 95/01416, to the contents of which express reference is hereby made.

Preferably the non-ionic surfactants are present in the compositions of the invention in an amount of from 0.1% wt to 5% wt, more preferably 0.5% wt to 3% wt, such as 0.5 to 3% wt.

The surfactants are typically included in amounts of up to 15% wt, preferably of from 0.5% wt to 10% wt, such as 1% wt to 5% wt in total.

Anti-Foam Agents

The detergent composition according to the invention may comprise one or more foam control agents. Suitable foam control agents for this purpose are all those conventionally used in this field, such as, for example, silicones and paraffin oil. If present, the foam control agents are preferably present in the composition in amounts of 5% by weight or less of the total weight of the composition.

Anti-Corrosion Agents

It is known to include a source of multivalent ions in cleaning compositions, and in particular in automatic dishwashing compositions, for technical and/or performance reasons. For example, multivalent ions and especially zinc and/or manganese ions have been included for their ability to inhibit corrosion on metal and/or glass. Bismuth ions may also have benefits when included in such compositions.

For example, organic and inorganic redox-active substances which are known as suitable for use as silver/copper corrosion inhibitors are mentioned in WO 94/26860 and WO 94/26859. Suitable inorganic redox-active substances are, for example, metal salts and/or metal complexes chosen from the group consisting of zinc, manganese, titanium, zirconium, hafnium, vanadium, cobalt and cerium salts and/or complexes, the metals being in one of the oxidation states II, III, IV, V or VI. Particularly suitable metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$ and $Ce(NO_3)_3$. Zinc salts are specially preferred corrosion inhibitors.

Therefore, an especially preferred optional ingredient according to the present invention is a source of multivalent ions such as those mentioned in the immediately preceding paragraph and in particular zinc, bismuth and/or manganese ions. In particular a source of zinc ions is preferred. Any suitable source of multivalent ions may be used, with the source preferably being chosen from sulphates, carbonates, acetates, gluconates and metal-protein compounds and those mentioned in the immediately preceding paragraph.

Any conventional amount of multivalent ions/multivalent ions source may be included in the compositions of the invention. However, it is preferred that the multivalent ions are present in an amount of from 0.01% wt to 5% wt, preferably 0.1% wt to 3% wt, such as 0.5% wt to 2.5% wt. The amount of multivalent ion source in the compositions of the invention will thus be correspondingly higher.

The detergent composition may also comprise a silver/copper corrosion inhibitor in conventional amounts. This term encompasses agents that are intended to prevent or reduce the tarnishing of non-ferrous metals, in particular of silver and copper. Preferred silver/copper corrosion inhibitors are benzotriazole or bis-benzotriazole and substituted derivatives thereof. Other suitable agents are organic and/or inorganic redox-active substances and paraffin oil. Benzotriazole derivatives are those compounds in which the available substitution sites on the aromatic ring are partially or completely substituted. Suitable substituents are linear or branch-chain $C_{1-20}$ alkyl groups and hydroxyl, thio, phenyl or halogen such as fluorine, chlorine, bromine and iodine. A preferred substituted benzotriazole is tolyltriazole.

Performance Polymers

Polymers intended to improve the cleaning performance of the detergent compositions may also be included therein. For example sulphonated polymers may be used. Preferred examples include copolymers of $CH_2{=}CR^1{-}CR^2R^3{-}O{-}C_4H_3R^4{-}SO_3X$ wherein $R^1$, $R^2$, $R^3$, $R^4$ are independently 1 to 6 carbon alkyl or hydrogen, and X is hydrogen or alkali with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulfonated monomers for incorporation in sulfonated (co)polymers are 2-acrylamido-2-methyl-1-propanesulfonic acid, 2-methacrylamido-2-methyl-1-propanesulfonic acid, 3-methacrylamido-2-hydroxypropanesulfonic acid, allysulfonic acid, methallysulfonic acid, 2-hydroxy-3-(2-propenyloxy)propanesulfonic acid, 2-methyl-2-propenen-1-sulfonic acid, styrenesulfonic acid, vinylsulfonic acid, 3-sulfopropyl acrylate, 3-sulfopropylmethacrylate, sulfomethylacrylamide, sulfomethylmethacrylamide and water soluble salts thereof. Suitable sulfonated polymers are also described in U.S. Pat. No. 5,308,532 and in WO 2005/090541.

When a sulfonated polymer is present, it is preferably present in the composition in an amount of at least 0.1 wt %, preferably at least 0.5 wt %, more preferably at least 1 wt %, and most preferably at least 3 wt %, up to 40 wt %, preferably up to 25 wt %, more preferably up to 15 wt %, and most preferably up to 10 wt %.

Enzymes

The detergent composition of the invention may comprise one or more enzymes. It is preferred that the enzyme is selected from protease, lipase, amylase, cellulase and peroxidase enzymes. Such enzymes are commercially available and sold, for example, under the registered trade marks Esperase, Alcalase and Savinase by Nova Industries A/S and Maxatase by International Biosynthetics, Inc. It is most preferred that protease enzymes are included in the compositions according to the invention; such enzymes are effective for example in dishwashing detergent compositions.

Desirably enzyme(s) is/are present in the composition in an amount of from 0.01 to 3 wt %, especially 0.1 to 2.5 wt %, such as 0.2 to 2 wt %.

Buffering Systems

The detergent composition according to the invention may comprise a buffering system to maintain the pH of the composition at a desired pH on dissolution and this may comprise a source of acidity or a source of alkalinity as necessary.

A source of acidity may suitably be any components which are acidic; for example polycarboxylic acids. Citric acid is especially preferred. Salts of these acids may also be used. A source of alkalinity may suitably be any suitable compound which is basic; for example any salt of a strong base and a weak acid such as soda. However additional acids or bases may be present. In the case of alkaline compositions silicates, phosphates or hydrogen phosphates may suitably be used. Preferred silicates are sodium silicates such as sodium disilicate, sodium metasilicate and crystalline phyllosilicates.

Perfume, Colours, Preservatives

The detergent compositions of the invention may also comprise minor, conventional amounts of perfumes, preservatives and/or colourants. Such ingredients are typically present in amounts of up to 2% wt.

Contrasting Parts

Preferred dosage forms have first and second parts which contrast with each other. They may contrast in the chemical nature of their components. Components may have different functions in a ware washing environment. They may be incompatible with each other. For example one component may interact adversely with another component to cause instability in storage or to reduce effective cleaning action, and such components may be segregated, one in the first part and one in the second part.

Alternatively or additionally the first and second parts may be arranged to release their components at different times in the washing process. This may be achieved by use of different coverings or skins for the components; for example by use of different wall materials for the first and second parts, with different rates of dissolution in the wash water and/or by use of walls of different thicknesses for the first and second parts.

Alternatively or additionally it may facilitate manufacture to separate certain components, and thereby create a contrast between the first and second parts.

Alternatively or additionally the first and second parts may contrast in their properties for aesthetic reasons.

The following are examples of contrasting first and second parts:

an enzyme in one part and a bleach in another part;

a corrosion inhibitor in one part and a bleach in another part;

a corrosion inhibitor in one part and an enzyme in another part;

an acid or a hydrolysable agent in one part and an alkalinity agent in another part;

a solid (including a powder or a gel) in one part and a liquid in another part;

a solid (including a powder or a gel) in one part and another solid (including a powder or a gel) in another part, to be kept apart, whether for chemical/functional reasons or aesthetic reasons;

a liquid in one part and another liquid in another part, to be kept apart, whether for chemical/functional reasons or aesthetic reasons;

a pre-wash formulation (including a ware washing machine cleaner, for example machine sanitizer and/or descaler), in one part and a main wash formulation in another part;

a main wash formulation in one part and a rinse aid formulation in another part.

It is an important advantage of the invention that different portions may be combined without the need for separation walls.

According to a second aspect of the invention, there is provided a method of manufacturing a dosage element for a ware washing machine, the method comprising the steps of:

(a) forming a sheet or film into a receptacle;

(b) introducing a flowable particulate composition into the receptacle;

(c) locally displacing the particulate composition inside the receptacle to form a hollow therein;

(d) introducing a gel or gel precursor into the hollow formed in the particulate composition; and (e) closing the receptacle with a lid.

Preferably step (c) is accomplished without compaction of the particulate material, i.e. it remains a non-consolidated particulate material which when not constrained by the receptacle is capable of flowing.

Preferably, prior to step (d) or (e) there is carried out a step (d1) or (e1) respectively in which a further component is introduced into the container. The further component may lie in or on the gel or gel precursor. Preferably, the further component is a solid form such as a pill. The further component may comprise a water-soluble or water-dispersible article. It may have a water-soluble polymeric skin containing active agents within.

In one embodiment step (d) comprises pouring a gel precursor into the hollow formed in step (c), at which location gelation occurs.

In another embodiment step (d) comprises locating a preformed gel in the hollow or forming the hollow with the preformed gel.

A said further component may be located in the hollow before or after the gel or gel precursor is itself introduced into the hollow.

Preferably, in step (e) the container and lid are sealed to each other, for example by adhesive (including water) or by heat sealing.

According to a third aspect of the invention, there is provided a method of manufacturing a dosage element for a ware washing machine, the method comprising the steps of:

(a) forming a sheet or film into a receptacle;

(b) introducing a gel or gel precursor into the receptacle;

(c) introducing a flowable particulate composition into the receptacle on top of the gel or gel precursor; and (e) closing the receptacle with a lid.

Preferably step (c) is accomplished without compaction of the particulate material. That is, it remains a flowable particulate material i.e. it remains a non-consolidated particulate material which when not constrained by the receptacle is capable of flowing.

Preferably, prior to step (b) or (c) there is carried out a step (b1) or (c1) respectively in which a further component is introduced into the container. The further component may lie under, on or wholly or partly within or on the gel or gel precursor as described further hereinabove. Preferably, the further component is a solid form such as a pill. The further component may comprise a water-soluble or water-dispersible article. It may have a water-soluble polymeric skin containing active agents within.

Preferably, the receptacle is formed by thermoforming or injection moulding.

Preferably, in the second aspect the particulate composition is locally displaced by advancement and retraction of a probe or dibber. A suitable advancing pressure is 50 to 100 kPa. However use of a suitable preformed gel itself to locally displace the particulate composition is not excluded.

Preferably, a mould comprises a plurality of cavities for forming a plurality of first parts at one time.

Preferably, a second mould comprises a plurality of cavities for forming a plurality of second parts at one time.

The methods preferably comprise the step of separating the completed dosage elements into individual dosage elements or into groups of dosage elements, for example 4-16 in number, which are packaged in such groups and are intended to be separated into individual dosage elements by the user.

After the steps described above the dosage elements may be packaged.

Preferably the steps described above define the manufacturing method fully; that is, there is preferably no further substantive manufacturing step. In particular there is for example preferably no step of setting the dosage elements face-to-face, for example by folding.

The dosage element of the first aspect need not be made by the method of the second or third aspect. Nevertheless preferred aspects defined with reference to the second or third aspects may (unless not possible) be regarded as preferred aspects of the first aspect whether or not made by the method of the second/third aspects and vice-versa.

However, the dosage element of the first aspect is preferably made by the method of the second or third aspect. In a fourth aspect of the invention there is provided a dosage element made by a method of the second or third aspect.

According to a fifth aspect there is provided a method of ware washing in a machine, preferably a method of washing kitchenware in a dishwashing machine, using a dosage element of the first aspect. In this method the dosage element is wholly consumed in one wash cycle.

For a better understanding of the invention, and to show how embodiments of the same may be carried into effect, reference will now be made, by way of example, to the accompanying diagrammatic drawings in which:

FIGS. 1(*a*) to 1(*h*) illustrate a preferred process for forming a dosage element in accordance with an embodiment of the invention; and FIG. 2 is a perspective view of a dosage element in accordance with a preferred embodiment of the invention.

Referring to FIGS. 1(*a*) through (h) there will now be described a dosage element in accordance with a first embodiment of the invention and a method of manufacture thereof.

All wall materials are water-soluble PVOH.

In FIG. 1(*a*) there is shown a casing 10 which forms an open pocket and sits within a thermoforming mould. It is filled with a first substance A which is a particulate composition, in which a depression may be formed, and remain.

In FIG. 1(*b*) there is shown a next stage in the process of forming a dosage element. Here, a dibber 30 is used to approach the powder filled casing 10 and in step 1(c) to compact the powder and form a depression therein corresponding to the shape of the dibbing head 30. When the dibbing head 30 is removed in step 1(d), it can be seen that a hollow formation H is left.

FIG. 1(*e*) shows the next step in the process, where a viscous gel precursor forming a substance B is poured or injected into the hollow H to form gel layer 40.

FIGS. 1(*f*) and 1(*g*) show an optional procedure in which a pill 50 of a substance C is pressed into the gel layer 40 so as to sit in and on top of this gel layer.

Finally, in FIG. 1(*h*) there is shown the procedure in which a lid 20, in the form of a top film, is added, following a cooling period, to cap and seal the casing 10.

FIG. 2 shows a completed dosage element in accordance with the above construction.

The preferred process, in detail, for forming a dosage element in accordance with the above construction is as described below in steps (A) through (G).

(A) Forming the lower casing 10 as a primary component (bottom film) into a pocket, by thermoforming in the cavity of a thermoforming mould. A suitable forming temperature for the PVOH used is, for example, 120° C. The thickness of the film used to produce the pocket is preferably 90 to 120 μm in this embodiment. A suitable forming vacuum is 0 to 2 kPa.

(B) Introducing particulate composition A into the chamber formed by the lower casing 10.

(C) Locally displacing particulate composition A with a dibber 20 in order to form depression H for a gel B. A suitable stamping pressure is especially 50 to 100 kPa depending on the particulate composition A used.

(D) Pouring a precursor for gel B, preferably a gel/liquid, into the depression formed in step (c) to form a layer 40 and placing the further composition C preferably as a solid form such as a tablet 50, optionally PVOH coated, into the lower casing 10, preferably to be disposed in or on gel B.

(E) Applying a film lid 20 over the casing, whilst still in the mould. The thickness of the PVOH film is 60 to 75 μm in this embodiment.

(F) Sealing the casing 10 and the top film 20 together. The films may be sealed together by any suitable means, for example by means of an adhesive or by heat sealing. Other methods of sealing include infra-red, radio frequency, ultrasonic, laser, solvent (such as water), vibration and spin welding. An adhesive such as an aqueous solution of PVOH may also be used. The seal desirably is water-soluble if the containers are water-soluble. If heat sealing is used, a suitable sealing temperature is for example 125° C. A suitable sealing pressure is especially 500 to 700 kPa depending on the heat sealing machine used.

(G) Cutting the water-soluble article from neighbours with which is has been co-formed. Cutting may be effected by, for example, by HF or by mechanical punching).

Whilst only the formation of a single dosage element has been discussed, it will be appreciated that the manufacturing process utilised will form tens or hundreds of such elements at a time using thermoforming moulds having a large plurality of pockets for forming multiple dosage elements and using continuous large thermoforming sheet materials which, only during the cutting step G, divide up the individual elements.

Suitable chemical compositions are as follows. In these examples the powder is loaded into the receptacle. Next, the gel is loaded into the depression formed therein. Then, the "pill" is laid on top of the gel (see FIGS. 1 and 2).

EXAMPLE 1

Phosphate-containing composition and gel in one compartment having sodium percarbonate in a separate "pill" (Table 1 below) for use in an automatic dishwashing machine.

TABLE 1

| Raw Material | Powder (16.0 g) | Gel (2.5 g) | Pill (1.3 g) | Walls (0.4 g) |
|---|---|---|---|---|
| Sodium tripolyphosphate | 48.70 | | | |
| Sodium carbonate | 16.00 | | | |
| Tri-sodium citrate | 22.00 | | | |
| Phosphate speckles | 4.00 | | | |
| Benzotriazol | 0.40 | | | |
| HEDP 4 Na (88.5%) | 0.30 | | | |
| Protease[1] | 1.50 | | | |
| Amylase[1] | 1.00 | | | |
| 1,2-Propylenediglycol | 1.00 | | | |
| Perfume | 0.10 | | | |
| Sulfonated polymer[2] | 5.00 | | | |
| Glycerin | | 46.95 | | |
| Gelatin | | 3.00 | | |
| TAED | | 50.00 | | |
| Dye | | 0.05 | | |
| Percarbonate | | | 100 | |
| PVOH (bottom film)[7] | | | | 75 |
| PVOH (top film)[8] | | | | 25 |
| | 100 | 100 | 100 | 100 |

EXAMPLE 2

Phosphate-containing composition and gel in one compartment having sodium percarbonate in a separate pill (Table 2 below) for use in an automatic dishwashing machine.

TABLE 2

| Raw Material | Powder (16.0 g) | Gel (2.5 g) | Pill (1.3 g) | Walls (0.3 g) |
|---|---|---|---|---|
| Sodium tripolyphosphate | 48.70 | | | |
| Sodium carbonate | 16.00 | | | |
| Tri-sodium citrate | 22.00 | | | |
| Phosphate speckles | 4.00 | | | |
| Benzotriazole | 0.40 | | | |
| HEDP 4 Na (88.5%) | 0.30 | | | |
| Protease[1] | 1.50 | | | |
| Amylase[1] | 1.00 | | | |
| 1,2-Propylenediglycol | 1.00 | | | |
| Perfume | 0.10 | | | |
| Sulfonated polymer[2] | 5.00 | | | |

TABLE 2-continued

| Raw Material | Powder (16.0 g) | Gel (2.5 g) | Pill (1.3 g) | Walls (0.3 g) |
|---|---|---|---|---|
| Solid surfactant | | 46.95 | | |
| Polyglycol | | 10.00 | | |
| TAED | | 43.00 | | |
| Dye | | 0.05 | | |
| Percarbonate | | | 100 | |
| PVOH (bottom film)[7] | | | | 67 |
| PVOH (top film)[8] | | | | 33 |
| | 100 | 100 | 100 | 100 |

EXAMPLE 3

Phosphate-containing composition and gel in one compartment having a pressed pill adhered to the gel (Table 3 below) for use in an automatic dishwashing machine.

TABLE 3

| Raw Material | Powder (16.0 g) | Gel (2.5 g) | Pill (1.4 g) | Walls (0.3 g) |
|---|---|---|---|---|
| Sodium tripolyphosphate | 48.70 | | | |
| Sodium carbonate | 16.00 | | | |
| Percarbonate | 22.00 | | | |
| Phosphate speckles | 4.00 | | | |
| Benzotriazol | 0.40 | | | |
| HEDP 4 Na (88.5%) | 0.30 | | | |
| Protease[1] | 1.50 | | | |
| Amylase[1] | 1.00 | | | |
| 1,2-Propylenediglycol | 1.00 | | | |
| Perfume | 0.10 | | | |
| Sulfonated polymer[2] | 5.00 | | | |
| Solid surfactant | | 46.95 | | |
| Polyglycol | | 10.00 | | |
| TAED | | 43.00 | | |
| Dye | | 0.05 | | |
| Lactose | | | 20.00 | |
| Sodium CMC | | | 18.00 | |
| Sodium bicarbonate | | | 31.00 | |
| Citric acid | | | 16.00 | |
| Protease[1] | | | 8.00 | |
| HEDP 4 Na (88.5%) | | | 2.00 | |
| Polyglycol | | | 4.00 | |
| Mg-stearate | | | 0.50 | |
| Dye | | | 0.50 | |
| PVOH (bottom film)[7] | | | | 67 |
| PVOH (top film)[8] | | | | 33 |
| | 100 | 100 | 100 | 100 |

A pill is manufactured by compressing the above pill formula with a compression of 1200 kg/cm$^2$ (diameter 13.0 mm; height 8 mm; weight 1.4 g):

EXAMPLE 4

Zeolite-containing composition and gel in one compartment having pressed pill adhered to the gel (Table 4 below) for use in a laundry machine.

TABLE 4

| Raw Material | Powder (26.0 g) | Gel (3.5 g) | Pill (1.4 g) | Walls (0.3 g) |
|---|---|---|---|---|
| LAS | 12.58 | | | |
| Soap | 1.24 | | | |
| Alkylsulfate | 2.27 | | | |
| Phosphonate | 0.58 | | | |
| Polymer | 2.79 | | | |

TABLE 4-continued

| Raw Material | Powder (26.0 g) | Gel (3.5 g) | Pill (1.4 g) | Walls (0.3 g) |
|---|---|---|---|---|
| Zeolite | 10.46 | | | |
| Sodium carbonate | 26.81 | | | |
| Sodium sulfate | 2.96 | | | |
| Sodium silicate | 1.85 | | | |
| Amorphous silicate | 8.75 | | | |
| Antifoam substance | 0.47 | | | |
| Polyethyleneglycol | 0.15 | | | |
| Amylase | 0.26 | | | |
| Percarbonate | 25.50 | | | |
| Optical brightener | 0.29 | | | |
| Fragrance | 0.26 | | | |
| Water | 2.80 | | | |
| Solid surfactant | | 46.95 | | |
| Polyglycol | | 10.00 | | |
| TAED | | 43.00 | | |
| Dye | | 0.05 | | |
| Lactose | | | 20.00 | |
| Sodium CMC | | | 18.00 | |
| Sodium bicarbonate | | | 31.00 | |
| Citric acid | | | 16.00 | |
| Protease[1] | | | 8.00 | |
| HEDP 4 Na (88.5%) | | | 2.00 | |
| Polyglycol | | | 4.00 | |
| Mg-stearate | | | 0.50 | |
| Dye | | | 0.50 | |
| PVOH (bottom film)[7] | | | | 75 |
| PVOH (top film)[8] | | | | 25 |
| | 100 | 100 | 100 | 100 |

A pill is manufactured by compressing the above pill formula with a compression of 1200 kg/cm$^2$ (diameter 13.0 mm; height 8 mm; weight 1.4 g):

EXAMPLE 5

Phosphate-containing composition and gel in one compartment having PAP in a separate compartment (Table 5 below) for use in an automatic dishwashing machine.

TABLE 5

| Raw Material | Powder (16.0 g) | Gel (2.5 g) | Pill (1.3 g) | Walls (0.4 g) |
|---|---|---|---|---|
| Sodium tripolyphosphate | 48.70 | | | |
| Sodium carbonate | 16.00 | | | |
| Tri-sodium citrate | 22.00 | | | |
| Phosphate speckles | 4.00 | | | |
| Benzotriazole | 0.40 | | | |
| HEDP 4 Na (88.5%) | 0.30 | | | |
| Protease[1] | 1.50 | | | |
| Amylase[1] | 1.00 | | | |
| 1,2-Propylenediglycol | 1.00 | | | |
| Perfume | 0.10 | | | |
| Sulfonated polymer[2] | 5.00 | | | |
| Glycerin | | 46.95 | | |
| Gelatine | | 3.00 | | |

TABLE 5-continued

| Raw Material | Powder (16.0 g) | Gel (2.5 g) | Pill (1.3 g) | Walls (0.4 g) |
|---|---|---|---|---|
| Sulfonated polymer[2] | | 50.00 | | |
| Dye | | 0.05 | | |
| PAP[6] | | | 100 | |
| PVOH (bottom film)[7] | | | | 75 |
| PVOH (top film)[8] | | | | 25 |
| | 100 | 100 | 100 | 100 |

[1]Granules which contain approx. 3-10% active enzyme
[2]AMPS co-polymer
[3]Non-ionic low foaming surfactant
[4]Mixed poly alkoxylate grade, P 41/12000, Clariant
[5]Silicon oil
[6]PAP with particle size (Q50% <15 μm)
[7]PVOH foil, 90 μm, PT grade from Aicello
[8]PVOH foil, 60 μm, PT grade from Aicello
[9]Sodium salt of methyl-glycine-diacetic acid The container used in this example has one compartment. The powder is delivered into the powder compartment. The gel mixture is heated to 65° C. and stirred for 20 min. Then the gel is mounted on top of the powder, a "pill" is positioned on the gel and the gel is allowed to chill. The insert in the examples is either a water soluble capsule comprising a PAP composition or percarbonate or could be a compressed pill. Finally the caps are sealed with PVOH film.

In the PAP example the particle size of the PAP is suitably 0.01-100 μm (Q50%<15 μm).

The dosage element as described above provides a very convenient and arrangement that is easy to manufacture and results in the production of different portions within a dosage element without there being the need for extra separating walls or members to keep the integrity of the different components.

The invention claimed is:

1. A ware washing unit dosage element comprising a container enclosing both a non-consolidated particulate composition defining a first region and an anhydrous gel defining a second region wherein the first region is in direct contact with the second region, and wherein the container is of a water-soluble material, wherein the anhydrous gel comprises less than 10 wt. % water, and wherein the dosage element further comprises a pill or core of material which is on, under or partly within said gel.

2. The dosage element of claim 1, wherein the gel has a protruding portion which protrudes into the particulate composition and a second, wider, portion from which the protruding portion depends.

3. The dosage element of claim 1 wherein the contents of the container comprise dishwashing active agents.

4. A dosage element of claim 1 wherein the pill or core of material is a compressed pill.

5. A dosage element of claim 1 wherein the pill or core of material is an article coated with a water soluble polymer.

6. A dosage element of claim 1 wherein the anhydrous gel comprises less than 5 wt. % water.

7. A dosage element of claim 1 wherein the anhydrous gel comprises less than 2 wt. % water.

8. A dosage element of claim 1 wherein the anhydrous gel comprises a non-ionic surfactant.

9. A dosage element of claim 1 wherein the anhydrous gel comprises a thickening system, which thickening system comprises a liquid diluent and an organic or polymeric gelling additive.

10. A dosage element of claim 9 wherein the diluent is selected from alkylene glycol mono lower alkyl ethers, propylene glycols, ethoxylated or proxylated ethylene or propylene, glycerol ethers, glycerol triacetate, lower molecular weight methyl esters, amides, and non-ionic surfactants.

11. A method of manufacturing a ware washing unit dosage element claim 1 comprising the steps of:

(a) forming a sheet or film into a receptacle;

(b) introducing a flowable particulate composition into the receptacle;

(c) locally displacing the particulate composition inside the receptacle to form a hollow therein;

(d) introducing an anhydrous gel or an anhydrous gel precursor into the hollow formed in the particulate composition; and (e) closing the receptacle with a lid, wherein the receptacle and the lid are of a water-soluble material; wherein prior to step (d) or step (e) there is carried out at least one further sub-step (d1) or further sub-step (e1) in which a pill or core of material is introduced to the receptacle to lie on, under or partly within the gel or gel precursor.

12. The method of claim 11, wherein in step (c) the particulate composition is locally displaced by advancement and retraction of a probe or of a dibber.

13. The method of claim 11, wherein step (d) comprises pumping or pouring the gel or gel precursor into the space formed in step (c).

14. A method of manufacturing a ware washing unit dosage element claim 1 comprising the steps of:

(a) forming a sheet or film into a receptacle;

(b) introducing an anhydrous gel or an anhydrous gel precursor into the receptacle;

(c) introducing a flowable particulate composition into the receptacle on top of the gel or gel precursor; and (d) closing the receptacle with a lid, wherein the receptacle and the lid are of a water-soluble material; wherein prior to step (b) or step (c) there is carried out at least one further sub-step (b1) or further sub-step (c1) in which a pill or core of material is introduced to the receptacle to lie on, under or partly within the gel or gel precursor.

15. The method of claim 14, wherein the receptacle is formed by thermoforming in the cavity of a thermoforming mould.

16. The method of claim 14, wherein step (b) comprises pumping or pouring the gel or gel precursor into the receptacle.

17. A method of ware washing, comprising the steps of providing a ware washing dosage element according to claim 1 to an automatic dishwasher, providing wares to the automatic dishwasher, operating the automatic dishwasher.

* * * * *